United States Patent [19]

Schneider et al.

[11] Patent Number: 4,746,107

[45] Date of Patent: May 24, 1988

[54] VERSATILE PRINTED COPY SEVERING, FOLDING AND ASSEMBLING APPARATUS

[75] Inventors: Eckhard Schneider, Stadtbergen; Erwin Saalfrank, Neusäss, both of Fed. Rep. of Germany

[73] Assignee: M.A.N. Roland Maschinenfabrik AG, Offenbach am Main, Fed. Rep. of Germany

[21] Appl. No.: 32,858

[22] Filed: Mar. 31, 1987

[30] Foreign Application Priority Data

Apr. 26, 1986 [DE] Fed. Rep. of Germany ..... 3614263

[51] Int. Cl.[4] ..... B41F 13/56

[52] U.S. Cl. ..... 270/21.1; 270/44; 493/324

[58] Field of Search ..... 270/20.1, 21.1, 41, 270/44, 6–8, 57; 493/324, 344–345, 361–362

[56] References Cited

U.S. PATENT DOCUMENTS

| | | | |
|---|---|---|---|
| 3,948,504 | 4/1976 | Woessner et al. | 493/324 |
| 4,279,410 | 2/1981 | Bolza-Schunemann | 270/6 |
| 4,368,879 | 1/1983 | Hoshi | 270/6 |
| 4,564,183 | 1/1986 | Muller | 270/21.1 |
| 4,564,470 | 1/1986 | Schmitt | 270/21.1 |

FOREIGN PATENT DOCUMENTS

| | | | |
|---|---|---|---|
| 190570 | 8/1986 | European Pat. Off. | 270/21.1 |
| 3030706 | 2/1982 | Fed. Rep. of Germany | 270/21.1 |
| 2307743 | 11/1976 | France | 270/21.1 |
| 2575701 | 7/1986 | France | 270/21.1 |

*Primary Examiner*—Eugene H. Eickholt

*Attorney, Agent, or Firm*—Frishauf, Holtz, Goodman & Woodward

[57] ABSTRACT

To permit, selectively, assembly of different types of copy products (A1, A2), for example each containing different information, such as inserts advertising men's wear and ladies' wear, respectively, for a newspaper, first and second transverse severing and folding units (1, 8, 9, 10; 15, 18, 19, 20) are provided receiving, selectively, different portions (1*a*, 1*b*) of webs on which different copy product information is printed. An intermediate transport system (21, 25) is provided receiving, selectively, the first type of copy products (A1) from the first transverse severing and folding unit (1, 8, 9, 10) and, selectively, supplying the first type copy products with predetermined alignment to a folding flap cylinder (20) of the second severing and folding unit (15, 18, 19, 20), the second folding flap cylinder guiding the first copy products (A1) together with a severed, folded copy product (A2) of another type about a portion of its circumference and transferring the now joined copy products to, for example, a third folding unit (23) via an output transport system. The intermediate transport system which may include another folding flap cylinder (11) can be, selectively, enabled or disabled so that copy products can be supplied separately from either severing or folding units, for example via a delivery transport system (12, 13) and the current transport system (21, 22) separately. The separate webs may be cut portions from a single web which, for example, can be directed to the first severing and folding unit, for providing multiple folded inserts which can be selectively distributed by the intermediate transport system on the respective output transport system (21, 22) and the delivery system (12, 13).

6 Claims, 1 Drawing Sheet

VERSATILE PRINTED COPY SEVERING, FOLDING AND ASSEMBLING APPARATUS

Reference to related applications, assigned to the assignee of the present invention, the disclosures of which are hereby incorporated by reference: U.S. Ser. No. 892,713, filed July 31, 1986, Kobler and Schneider. U.S. Ser. No. 892,712, filed July 31, 1986, Kobler and now U.S. Pat. No. 4,720,091.

The present invention relates to folding and severing apparatus to sever a printed web received from a printing machine into copy products which, then, can be folded several times, and more particularly to such an apparatus in which the folded copy products can be arranged in accordance with different desired patterns.

BACKGROUND

It is frequently desired to provide folds on printed subject matter received from a printing machine and to insert folded cut copy products in different forms in other printed copies. This problem arises frequently when inserts are to be placed in newspapers or other publications. One type of printed copy product may, for example, contain advertisements for ladies' wear; another type advertisement for men's wear. Selected issues of the newspaper may carry both advertisements, whereas other issues or other publications may, selectively, only carry the one or the other type of insert. In the past, it was necessary to generate the different types of inserts—for example for ladies' wear and men's wear—in two separate folding groups or folding apparatus, and then assemble them together, for subsequent introduction, for example, in a newspaper or the like. This, of course, requires substantial apparatus and additional time.

THE INVENTION

It is an object to provide a versatile apparatus which, selectively and as desired, provide folded insert copy products which may be of one type, two types folded together, or two types folded separately. The final product to be obtained then, selectively, should be available with both types of inserts folded into each other, or provided separately. The insertion step of adding a completed folded insert unit into a newspaper, for example, or other printed product then is simple. The apparatus, in accordance with a further object of the invention, should be compact and changeable to different modes of operation without requiring essential set-up and change-over time.

Briefly, first and second transverse folding and severing units are provided, located physically one above the other. The first and second folding and severing units receive printed paper webs, and provide, respectively, the individually different types of inserts. An intermediate transport system receives a first-type folded product from the first folding and supplies the copy products to a folding flap cylinder which receives the second type of folded products or inserts, where the first type and the second type can be combined and then, together, transported to an output transport system for, for example, conjoint introduction into a newspaper or the like, or other subsequent handling. If such a mode of operation is not desired, the joining step at the flap cylinder can be bypassed and, selectively, first and second types of folded products can be folded individually; or one type only of copy product can be produced to form the insert. A single web, folded longitudinally, may only be supplied to the first transverse folding and severing unit which makes a first transverse fold. A subsequent fold, then, can be made to form one thick insert.

FIG. 1 is a schematic view of the copy severing, folding and assembling apparatus, illustrating the arrangement of the paths of the incoming paper web and the copy products; and FIGS. 2, 3 and 4, schematically, illustrate the types of different folded output available from the apparatus and system illustrated.

DETAILED DESCRIPTION

Figure 2:
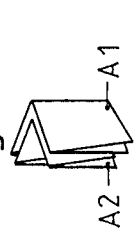

The overall system which, actually, is an assembly of different units, has folding units 1, 15. Only the first folding unit 1 will be described in detail. The second folding unit may be constructed in similar fashion. The individual components of the of the folding units, themselves, are well known and may be constructed according to suitable and standard design.

A paper web 3 is passed over a former 2. The paper web may be slit longitudinally by a slitter 2*a*. Let it be assumed that the paper web is slit, or that two superimposed webs are supplied. If the webs are slit, or two are supplied, a web or web portion—if slit—1*a* is fed to the first folding and separating unit 1, whereas a second web portion 1*b* is fed to the second folding and severing unit 15. The web or webs is/are creased by a pair of former rollers 4, and pulled over the former by pulling rollers 5. The web portion 1*a*, which may be slit or unslit, forms a first web 3 which is transversely perforated by a perforating cylinder pair 6. It is pulled downwardly by a further pulling cylinder or roller pair 7. The web portion l*a* or, for example, a solid unslit and folded web 3 is then severed into suitably cut lengths by a knife cylinder 9 which cooperates with a folding blade cylinder 8. The folding blade cylinder 8 receives the cut copy products of the first type, hereinafter referred to as the type A1. The folding blade cylinder 8 carries holding needles 8', and well known in such cylinders, to retain the copy products A1 at their leading edge. The folding cylinder 8 has insertion blades which, after transfer of the copy products A1 to a folding flap cylinder 10, project a portion of the copy products A1 into suitable flaps 10' of the cylinder 10. The folding blades on cylinder 8 are shown schematically at 8''. The severing or cutting arrangement and subsequent folding by cylinders 9, 8, 10, by themselves, are well known. The cutting cylinder 9, folding blade cylinder 8, and folding flap cylinder 10, together, form the first transverse severing and folding unit 1 which forms the first cross fold or transverse fold. It may be the second fold for the printed web if the web has been passed over the former 2 and folded thereby.

The folded copy products A1, having one cross fold, are transferred to a web transport system formed by transport belts 12, 13.

In accordance with a feature of the invention, the cross-folded copy products then are transported, linearly, to a folder apparatus 14 which, by means of a reciprocating folding blade, forms a further fold in the already folded copy products A1. Such folders 14 are well known. With respect to the incoming web 3, or web portion 1*a*, the further fold at station 14 will be a longitudinal fold. Of course, the folder 14 which, again, will be of standard construction and usually includes a reciprocating folding blade, may also be formed as a transverse folder.

In accordance with a feature of the invention, a second transverse fold may be formed by an additional folding cylinder 11, cooperating with the folding flap cylinder 10. The additional folding cylinder 11 is formed with grippers 11', of standard and well known construction. Thus, the copy products A1 may receive a second transverse fold, if this is desired. In accordance with a further feature of the invention, the folding blade cylinder 11 permits yet another operating mode in that the folded copy products A1 are gripped by the grippers 11' and, rather than being transported through the transport belt system 12, 13, are supplied to a transport belt system formed by belts 24, 25. The folded, severed copy products A1 then will reach the second severing and folding unit 15. The second severing and folding unit 15 may be essentially identical to the first unit 1. It is positioned at a different vertical elevation, preferably above the unit 1. A deflection roller 26, located at an elevation above the folding flap cylinder 10, lifts the copy products A1 to the appropriate inlet region of the second unit 15.

Let it be assumed that a web supplied to the former 2 has been severed and slit by the slitter **2*a*, to provide the web portion 1*b*. The web portion 1*b* is guided over tension control rollers 16 to a pair of pulling rollers 17 and then to the second severing and folding unit 15. The second severing and folding unit 15 has a knife blade cylinder 18 to sever the web into suitable lengths, a folding blade cylinder 19 with pick-up pins or points 19' and folding blades 19''. It cooperates with a folding flap cylinder 20 having folding flaps 20'**.

The system in accordance with the present invention, thus, permits a second mode of operation in which the transversely folded copy products A1 are supplied by the transport belts 24, 25 via the guide roller 26 to the folding flap cylinder 20. The copy products A2, derived upon severing and folding of the web **1*b*, are also retained and guided on the folding flap cylinder 20, by being retained within the folding flaps 20'. In accordance with a feature of the invention, the copy products A1 and the copy products A2 are aligned with their leading edges on the folding flap cylinder 20. The copy products A1, A2, now combined on the folding flap cylinder 20, are carried over a portion of the circumference about the folding flap cylinder 20, and then are received by a transport belt system formed by belts 21, 22. The transport belt system 21, 22 transports both of the copy products A1 and A2, together, to another folder 23 which folds the products A1, A2 in one operation within each other. The output from the folder 23 is seen in FIG. 2, which shows the folded products A1 and A2, slightly spread apart, for illustration, but as folded in folder 23**. The products A1, A2 are separate from each other.

The arrangement, thus, simply and with a mininum of components permits folding together as a single insert the copy products A1 and A2, of different types, within each other, to provide a common insert product which, for example, can be inserted in a newspaper.

Figure 3:
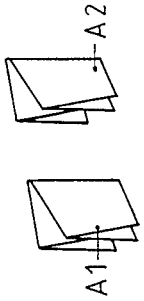

FIG. 3 illustrates the copy products which are also available if the web portions **1*a*, 1*b* are handled separately in the severing and folding units 1, 15, each one cross-folded once, and then transversely folded by the respective folders 14, 23. Thus, merely by not gripping the folded products on the folding flap cylinder 10 by the folding blade cylinder 11 which is formed with grippers, that is, by not operating the grippers on the folding blade cylinder 11, the products can be separately provided, for example for separate editions of a newspaper. Thus, an insert, for example destined for a metropolitan edition of a newspaper, and folded in the folding unit 1, can be provided, whereas inserts folded in the folding unit 15 can be provided for a suburban edition. The grippers on the cylinder 11** may operate in accordance with standard gripper construction.

Figure 4:
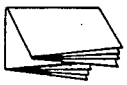
Figure 1:
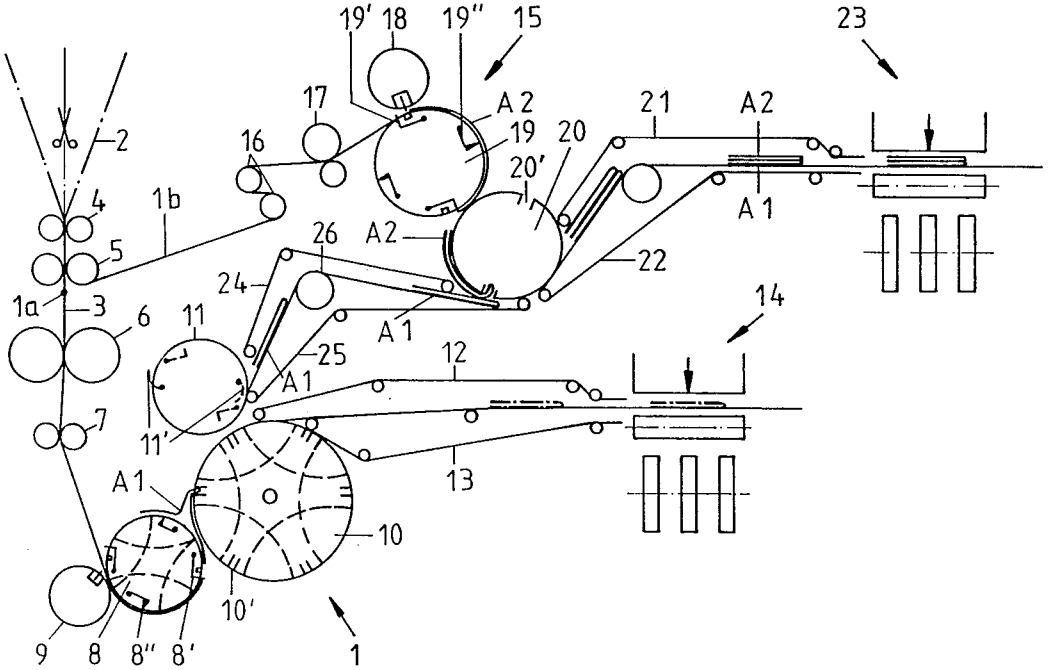

The system has the additional versatility that it is also possible to provide a single multiple-folded insert. If the cutter or slitter **2*a* is disabled or disconnected, the former 2 will fold a web 3 which, then, will be provided as double web, having already one longitudinal fold. The uncut longitudinally folded web 3 is then applied to the first severing and folding unit 1. When the folded and severed units A1 are on the flap cylinder 10, they can be handled, selectively, by either one of the transport systems 12, 13 or 24, 25. For example, they may be gripped by the grippers of the folding blade cylinder 11 and transferred to the transport belt system 24, 25, then over a portion of the circumference of the folding flap cylinder 20 and to the transport belt system 21, 22 to form another longitudinal fold 23—see FIG. 4. Alternatively, they may be transferred directly from the folding flap cylinder 10 via the belt system 12, 13 to the lower folder 14, resulting in the same copy product illustrated in FIG. 4, unless the folding blade cylinder 11** has formed another transverse fold into the copy products.

By splitting the various functions of folding, and associating intermediate transport belt systems with the respective severing and folding units, it is possible to substantially increase the operating speed of the overall system. The folding flap cylinder 20 is partially integrated into the transport path also in the system just described, and resulting in the copy products of FIG. 4. It is possible to alternately supply folded copy products to the folder 14 or the folder 23 by suitably controlling the grippers on the folding blade cylinder 11.

The overall system is compact. Only little time is necessary to change over the operating mode between the respectively possible production modes to obtain folded copy products of different folding patterns, see FIGS. 2, 3 and 4.

The printed copy products A1, A2 are preferably joined together at the folding flap cylinder 20 with high accuracy. This is easily possible if the folding flap cylinder 20 can be circumferentially adjusted for precise leading-edge association of the respective folding products A1, A2. The copy products A2 are still held in the folding flaps 20' at this adjustment.

Various changes and modifications may be made. For example, rather than using the lower transport belts 25, 22 of the two belt systems 24–25 and 21–22, a single continuous belt may extend from the gripper and folding blade cylinder 11 to the upper folder 23. This belt, then, would be looped in part about the circumference of the folding flap cylinder 20. The system can readily be modified, and existing severing or cutting, folding and transporting arrangements can be used to provide the overall system in accordance with the present invention.

What is claim is:

1. Versatile printed copy severing, folding and assembling apparatus, adpated to receive a first and, selectively, a second printed web or web portions, severing the web (3) or web portions (**1*a*, 1*b*) into copy products of respectively different types (A1, A2), and selectively folding and assembling said different types of products together, or separately, in accordance with the selected assembly or folding pattern or mold, comprising, in accordance with the invention, a first transverse severing and folding unit (1; 8, 9, 10) receiving the web (3) or the first web portion (1***a*), severing said web or web portion and forming a first type copy product (A1) having a first transverse fold, said first transverse severing and folding unit including a first folding flap cylinder (10);

a second transverse severing and folding unit (15; 18, 19, 20) receiving, selectively, the second web portion (1*b*) and forming a second transversely folded copy product (A2) having a first transverse fold, the second transverse severing and folding unit (15; 18, 19, 20) including a second folding flap cylinder (20);

said first and said second severing and folding units being positioned in vertically staggered locations;

an intermediate transport system (11, 24, 25) selectively receiving the first type copy products (A1) from the first tranverse severing and folding unit (1; 8, 9, 10) and supplying said first type copy products with predetermined alignment on the second folding flap cylinder (20);

said second folding flap cylinder transporting the second type copy products (A2) together with the first type copy products (A1) about a portion of its circumference;

an output transport system (21, 22) receiving the second and selectively the first copy products from the second folding flap cylinder (20);

and a folder (23) for forming a further fold in the copy products delivered thereto by said output transport system.

2. The apparatus of claim 1, further including a folding former (2) and a slitter (2*a*) slitting a web (3) applied to the former into said two web portions (1*a*, 1*b*);

first guide roller means (6, 7) supplying the first web portion (1*a*) to said first severing and folding unit (1, 8, 9, 10);

second guide roller means (16, 17) supplying the second web portion (1*b*) to the second severing and folding unit (15, 18, 19, 20);

each one of said severing and folding units including a cutting cylinder (9, 18), a folding blade cylinder (8, 19) receiving cut web portions, and a folding flap cylinder (10, 20) to form first transversely folded copy products (A1, A2);

and an intermediate folding blade cylinder (11) having copy product grippers (11') engageable with the folding flap cylinder (10) of said first severing and folding unit (1), said intermediate folding blade cylinder, selectively, providing a further fold on the first folding flap cylinder (10) or receiving folded products from the first folding flap cylinder (10), gripping said products and transporting said products to the intermediate transport system for subsequent transport to the second folding flap cylinder (20) of the second severing and folding unit (15; 18, 19, 20).

3. The apparatus of claim 1, including a folding former (2) receiving a continuous web, and folding said web to form a first longitudinal fold and provide a folded continuous web (3);

first guide roller means (6, 7), transporting said first longitudinally folded web (3) to said first transverse severing and folding unit (1; 9, 8, 10) to form a first transverse fold;

an intermediate cylinder (11) having copy product grippers (11') thereon, said intermediate cylinder gripping alternate copy products (A1) on the first folding flap cylinder (10) and transporting said alternately gripped copy products to said intermediate transport system (24, 25);

and a copy delivery system (12, 13) coupled to the first folding flap cylinder and transporting the copy products (A1) which were not gripped by the intermediate cylinder.

4. The apparatus of claim 3, further including a further folder (14) receiving the copy products from the delivery unit (12, 13) and providing a further fold therein.

5. The apparatus of claim 3, wherein the intermediate cylinder comprises a combined folding flap-gripper cylinder (11).

6. The apparatus of claim 1, futher including a delivery system (12, 13) coupled to receive folded products (A1) from the first folding flap cylinder (10);

said further folder (14) receiving the delivered copy products (A1) from the delivery system;

and wherein the second copy products (A2) are supplied, separately, to said output transport system, without copy products being delivered to the second folding flap cylinder (20) by said intermediate transport system.

* * * * *